US005118252A

United States Patent [19]

Chaney

[11] Patent Number: 5,118,252

[45] Date of Patent: Jun. 2, 1992

[54] INTAKE GRILL FOR ELECTRIC FAN ASSEMBLY

[75] Inventor: David B. Chaney, Powell, Ohio

[73] Assignee: The W. B. Marvin Manufacturing Company, Urbana, Ohio

[21] Appl. No.: 528,208

[22] Filed: May 24, 1990

[51] Int. Cl.[5] ..... F01D 25/00

[52] U.S. Cl. ..... 415/119; 415/191; 416/247 R

[58] Field of Search ..... 415/119, 200, 208.1, 415/208.2, 191, 182.1, 183, 185; 416/247 R

[56] References Cited

U.S. PATENT DOCUMENTS

| | | | |
|---|---|---|---|
| D. 97,118 | 10/1935 | Cohen . | |
| D. 164,139 | 7/1951 | Sebastian . | |
| D. 307,320 | 4/1990 | Shin-Chin . | |
| 1,966,787 | 7/1934 | Buri | 415/185 |
| 1,990,801 | 2/1935 | Spear . | |
| 2,100,994 | 11/1937 | Cohen | 416/247 |
| 2,154,313 | 4/1939 | McMahan | 415/208.2 |
| 2,715,495 | 8/1955 | Sebastian . | |
| 2,950,859 | 8/1960 | Kirk | 415/191 |
| 3,178,099 | 4/1965 | Child | 415/208.1 |
| 4,120,615 | 10/1978 | Keem et al. | 416/247 R |
| 4,341,151 | 7/1982 | Sakamoto . | |
| 4,350,472 | 9/1982 | Morimoto . | |
| 4,365,930 | 12/1982 | Ogura et al. . | |
| 4,425,840 | 1/1984 | Morimoto . | |
| 4,521,153 | 6/1984 | Morimoto . | |
| 4,761,115 | 8/1988 | Hopfensperger | 415/119 |
| 4,838,151 | 6/1989 | Shin-Chin . | |
| 4,872,399 | 10/1989 | Chaney . | |
| 4,927,324 | 5/1990 | Coup et al. . | |

FOREIGN PATENT DOCUMENTS

| | | | |
|---|---|---|---|
| 0195896 | 12/1982 | Japan | 415/200 |

OTHER PUBLICATIONS

Lasko copy of advertisement.

Copy of Lakewood fan catalogue, p. 9, High Velocity Reversible Window Fan, copy in p. 23 (Coding Except Ceiling Fans).

*Primary Examiner*—Edward K. Look

*Assistant Examiner*—Christopher M. Verdier

*Attorney, Agent, or Firm*—Roger S. Dybvig

[57] ABSTRACT

The noise of operation of a fan assembly having a fan blade which rotates in a predetermined direction upon operation of the fan assembly may be reduced by the use of an intake grill including an inner central portion, ring elements disposed in mutually spaced, concentric relation to one another about the central portion, and spirallly-extending support elements connected to the central portion and to the ring elements. The intake grill further includes mutually circumferentially-spaced finger elements connected to and projecting away from a grill mounting surface which are also connected to the outermost ring element and thereby support the interconnected ring elements, central portion, and support elements in spaced relation to the grill mounting surface. Stiffening elements may be disposed between adjacent support elements and connected to selected adajcent ones of the ring elements.

10 Claims, 3 Drawing Sheets

INTAKE GRILL FOR ELECTRIC FAN ASSEMBLY

BACKGROUND OF THE INVENTION

This invention relates to an intake grill for an electric fan assembly and, although not so limited, this invention more particularly relates to an air intake grill incorporated in an electric fan assembly for household use.

Household fan assemblies typically incorporate intake and exhaust grills which function as guards for the fan blade and, in many constructions, as structures for directing air flowing into and away from the fan blade.

Air intake grills have been designed in several different configurations. A known grill configuration is composed of a plurality of circular bars or rods which are concentrically arranged about a central hub of the grill and suported by a plurality of radially extending circular bars or rods. Such a grill construction provides a substantial open area for passage of air into the fan assembly. However, fans with this type of grill construction may produce undesirable levels of noise during operation, particularly at high fan blade speeds and with fan assemblies wherein the grill is located close to the fan blade.

Since the marketability of fan assemblies can be adversely affected by undesirable noise levels, a continuing need exists for improved fan assemblies which will bring about reduction in noise levels.

SUMMARY OF THE INVENTION

The present invention provides an improved air intake grill for a fan assembly, and particularly an intake grill which reduces noise produced during operation of a fan assembly while still providing a susbstantial open area to enable a large volume of air to pass through the intake grill. A known grill configuration is composed of a plurality of circular bars or rods which are concentrically arranged about a central hub of the grill and supported by a plurality of radially extending circular bars or rods. Such a grill construction provides a substantial opening for passage of air into the fan assembly. In accordance with this invention, the noise of operation of a fan assembly may be significantly decreased by providing an intake grill with a plurality of circular bars or rods which are concentrically arranged about a central hub of the grill and a plurality of support elements which slope or extend angularly from a central portion to an outer ring of the grill in the direction of fan blade rotation. Fan assemblies with intake grills that extend radially or which slope in a direction opposite to the direction of fan rotation are quite noisy by comparison.

Accordingly, the present invention is directed to an air intake grill for a fan assembly having a fan with a fan blade which rotates in a predetermined direction. The intake grill is connected to a grill mounting surface on the fan assembly. The grill mounting surface has a central opening and the intake grill comprises: an inner central portion; a plurality of ring elements disposed in mutually spaced, concentric relation to one another and about the central portion; means for attaching at least an outermost one of the ring elements to the grill mounting surface; and a plurality of support elements extending between the central portion and the outermost ring element and being connected at their inner ends to the central portion at circumferentially spaced locations thereabout and at their outer ends to the outermost ring element at circumferentially spaced locations thereabout which are circumferentially displaced from their inner ends in the predetermined direction of rotation of the fan blade, each support element also being connected at spaced portions therealong with the ring elements between the outermost ring element and the central portion.

Each support element preferably has an arcuately convex or spiral configuration with its outer end being radially and circumferentially displaced from its inner end in the predetermined direction of rotation of the fan blade. The inner end of each support element extends approximately in tangential relationship to the central portion. The outer end of each support element is displaced within a range of approximately ninety degrees to one hundred twenty degrees from its inner end.

Further, the attaching means is preferably a plurality of mutually-spaced finger elements attached on the outer mounting portion and extending away therefrom in the same direction. At least the outermost ring element is connected to outer ends of the finger elements for supporting the interconnected central portion, the ring elements, and the support elements in a spaced relation from the mounting portion. Preferably, the outer mounting portion, the inner central portion, the concentric ring elements, the finger elements, and the arcuate support elements are a one-piece molded plastic structure.

Additionally, the intake grill may include a plurality of stiffening elements disposed between adjacent ones of the support elements and connected to the ring elements. The stiffening elements are arcuately canted in the predetermined direction of rotation of the fan blade and extend along imaginary spiral lines that duplicate the spiral centerlines of the support elements but are located between adjacent support elements. Such stiffening elements are of value if needed to add to the stiffness of the intake grill construction for purposes of safety.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
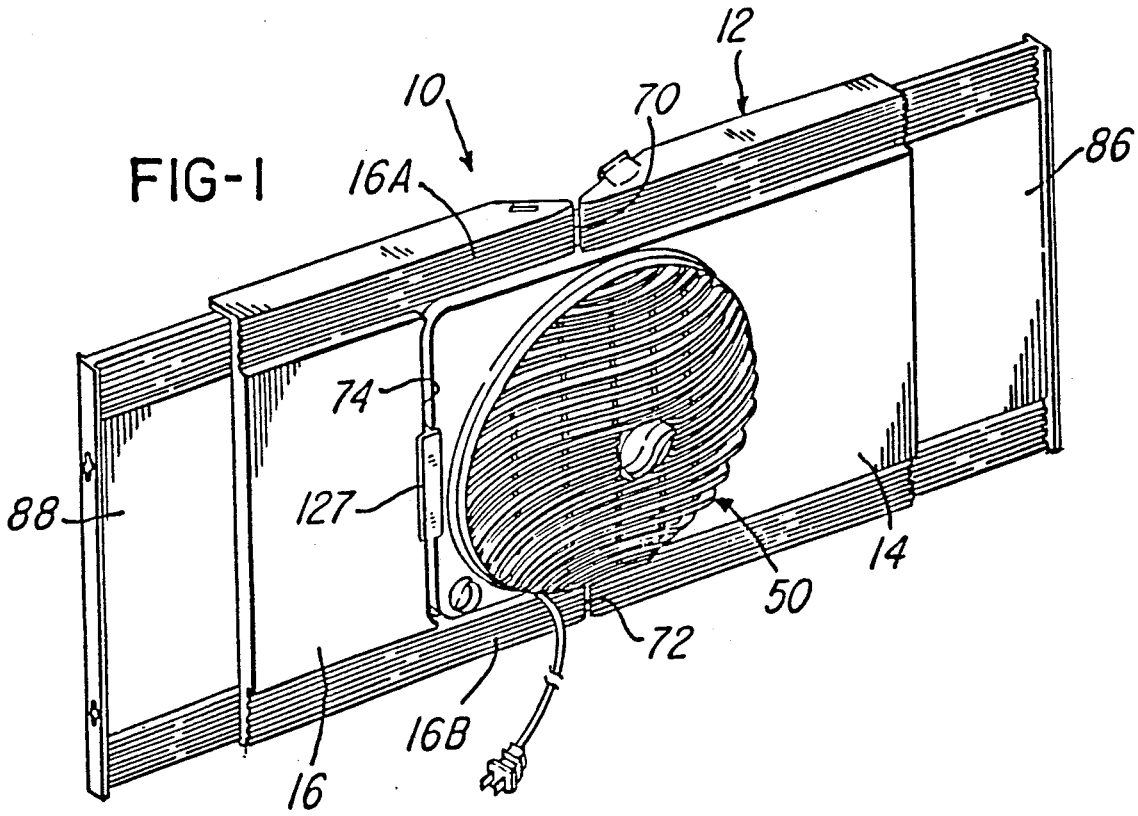
FIG. 1 is a perspective view of a fan assembly of a type that may advantageously utilize the intake grill of this invention shown converted for use as a window fan

Referring to the drawings, this invention is shown in connection with a convertible fan assembly, generally designated 10, of the type disclosed in my U.S. Pat. No. 4,872,399, granted Oct. 10, 1989, titled "Convertible Fan Assembly", the disclosure of which is hereby incorporated herein by reference. In the following description, like reference characters designate like or corresponding parts throughout the figures, and where possible, designate like or corresponding parts of the figures of said U.S. Pat. No. 4,872,399, which may be consulted for details of construction. Also in the following description, it is to be understood that such terms as "front" and "rear", "upper" and "lower", "right" and "left", and the like, are words of convenience and are not to be construed as limiting terms.

Figure 2:
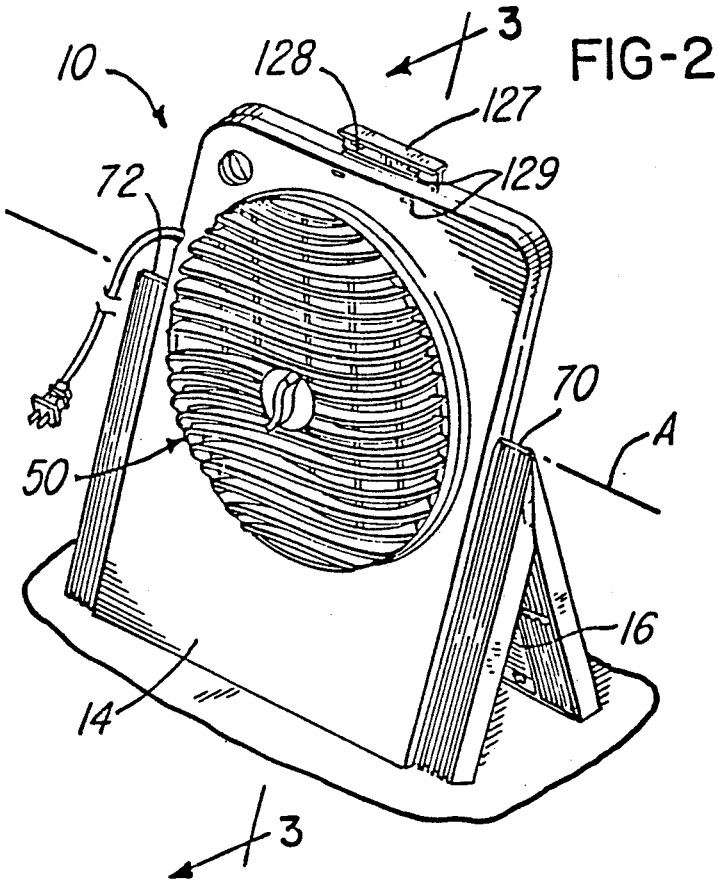
FIG. 2 is a perspective view of the convertible fan assembly of FIG. 1 shown converted for use as a floor fan.

Briefly, the fan assembly 10 comprises a one-piece, molded plastic, rectangular, fan support member, generally designated 12, comprising a first, larger, support panel 14 and a second, smaller, support panel 16. A pair of living hinges 70 and 72 formed by thin-walled sections of suitable material, preferably polypropylene, connect the upper and lower edge portions, respectively, of the panels 14 and 16. The smaller panel 16 is of a generally rectangular construction and has a substantially C-shaped cutout region 74 adapted to receive the confronting portion of larger panel 14. The living hinges 70 and 72 form a pivot axis "A" perpendicular to the upper and lower edges of the support member 12 located centrally between and parallel to the side edges of the support member 12. The upper and lower arms, designated 16A and 16B, of the smaller panel 16 that form top and bottom portions, respectively, of the C-shaped cutout region 74 extend to the living hinges 70 and 72 so that the panels 14 and 16 may be pivoted relative to one another about the pivot axis "A". Accordingly, the panels 14 and 16 may selectively be oriented flat in a coplanar position as shown in FIG. 1, for use of the fan assembly 10 in a window, or oriented folded, as shown in FIG. 2, with the panels 14 and 16 at an acute included angle with respect to one another for use of the fan assembly 10 on a desk or floor.

The fan assembly 10 further includes a pair of extenders 86 and 88, one for each of the longer panel 14 and the shorter panel 16, respectively. These extenders are used, as is well known in the art, to extend the effective width of the fan assembly 10, when used in a window, to ensure that the entire width of the window is covered.

An electrically operated fan having a blade 42 is mounted in the larger panel 14 between a circular exhaust grill 50 and a circular intake grill 56. The exhaust grill 50 is preferably controllably rotatable as described in said U.S. Pat. No. 4,872,399. The intake grill 56, which is the subject of this invention and is hereafter described in detail, is preferably integrally formed with a substantially square venturi ring assembly 46 which is fixedly-mounted on the larger panel 14. The venturi ring assembly includes a generally cylindrical outer wall 48 at the rear end of which is a venturi ring 49 surrounding the fan blade 42.

An improvement is incorporated into the fan assembly 10 that is not shown in said U.S. Pat. No. 4,872,399. This comprises a T-shaped, combined stop member and handle 127 that extends from the top edge of the larger panel section 14 when the fan assembly is used as a desk or floor fan as shown in FIG. 2, and to which it is connected by an integrally formed living hinge 128. With the fan assembly oriented as shown in FIG. 2, the member 127 forms a convenient handle for the fan assembly 10. When set up as shown in FIG. 1, the member 127 is pivoted about its hinge 128 into the position shown in FIG. 1 wherein the head of the T-shaped member provides a stop to prevent the smaller panel section 16 from being pivoted past 180 degrees relative to the larger panel section 14, which could result in damage to the living hinges 70 and 72. Cooperating interference elements 129 on the underside of the head of the T-shaped member 127 and on the front face of the larger panel section 14 lock the the T-shaped member 127 in its stop position shown in FIG. 1 to prevent its hinge 128 from biasing the smaller panel section 16 out of its coplanar relationship with the larger panel section 14.

The air intake grill 56 of the present invention incorporated in the fan assembly 10 is mounted on the venturi ring assembly 46 so as to cover the rear face of the electric fan and reduce the noise of fan operation. The electric fan is not illustrated in FIGS. 1, 2, and 3, in order to avoid a confusion of lines. Parts of the fan are illustrated in FIG. 4 and are further illustrated in said U.S. Pat. No. 4,872,399. Of importance for purposes of this invention, the fan blade 42 (FIG. 4) rotates in the direction of the arrow W in FIG. 3.

Figure 3:
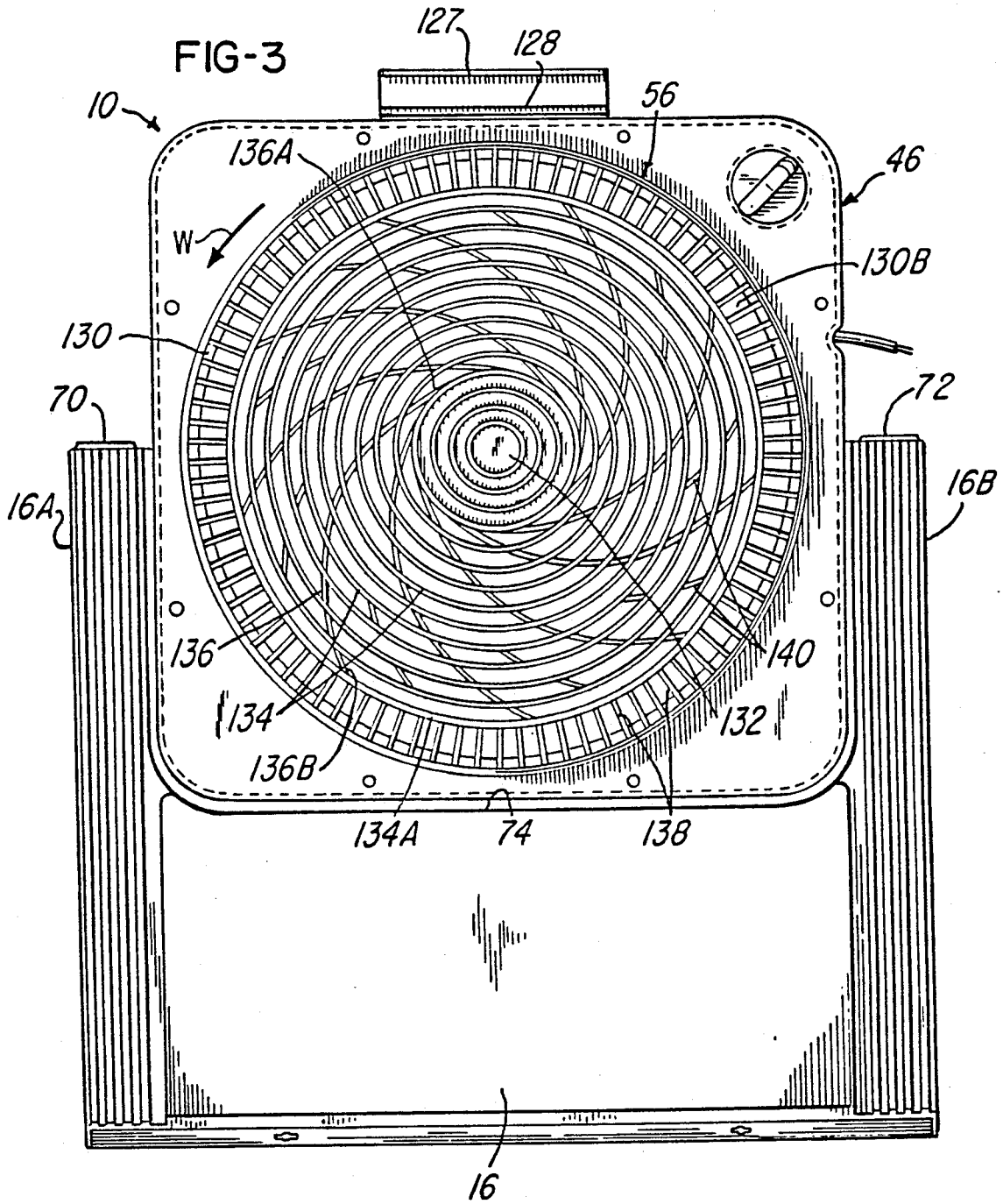
FIG. 3 is rear view of the fan assembly of FIG. 1 taken in the direction of arrows 3—3 of FIG. 2 and comprises a projection on a plane parallel to and facing the outermost surface of the intake grill of this invention.
Figure 4:
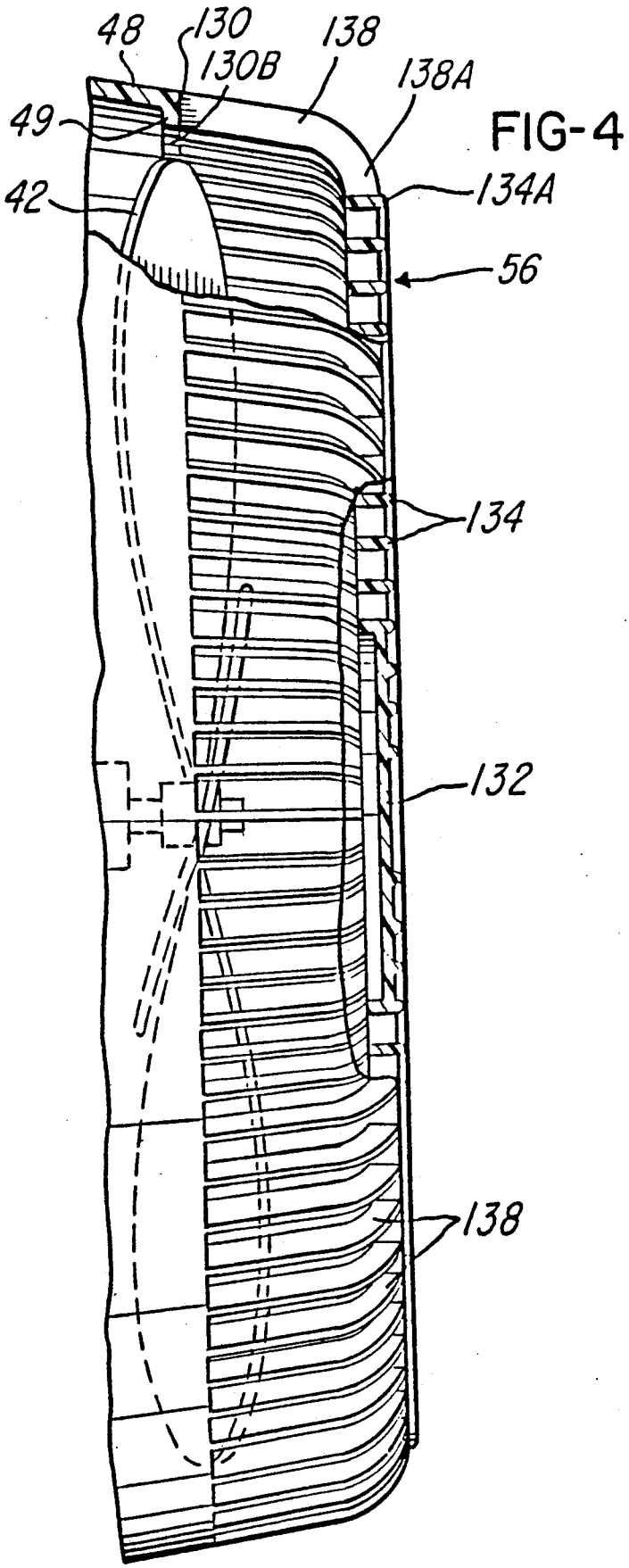
FIG. 4 is a fragmentary side elevation, with parts broken away and parts shown in cross section, of the intake grill of this invention and parts of the fan assembly to which the intake grill is connected.

As seen in FIG. 3, the intake grill 56 is mounted on a circular, outwardly-facing, grill mounting surface 130 of the venturi ring 49, which surface has a central opening 130B that receives the fan blade 42.

The intake grill 56 comprises an inner central plate-like circular portion 132 and a plurality of ring elements 134 disposed in mutually spaced, concentric relation to one another about the central portion 132. Further, the intake grill 56 has a plurality of support elements 136 in the form of elongate rods extending between the inner central portion 132 and the outermost ring element, designated 134A. The support elements 136 are connected at their inner ends 136A to the central portion 132 at circumferentially spaced locations thereabout and at their outer ends 136B to the outermost ring element 134A at circumferentially spaced locations thereabout which are radially and circumferentially displaced from their inner ends 136A in the predetermined direction of rotation of the fan blade 42. Each of the remaining ring elements 134 disposed between the outermost ring element 134A and the central portion 132 is also connected to each of the support elements 136 at spaced locations therealong.

More particularly, each support element 136 has a convexly arcuate or spiral configuration with its outer end 136B being radially and circumferentially displaced from its inner end 136A in the predetermined direction of rotation of the fan blade 42. Further, the inner end 136A of each support element 136 extends approximately in tangential relationship to the central portion 132. The outer end 136B of each support element 136 is displaced within a range of approximately ninety degrees to one hundred twenty degrees from its inner end 136A.

The support elements 136 could each be straight rather than arcuate and in some cases such straight support elements may produce a satisfactory reduction in the noise resulting from fan operation. However, in every case, it is important that the support elements 136 slope or extend angularly in the direction of fan blade rotation.

The intake grill 56 also includes a plurality of mutually, circumferentially-spaced, finger elements 138 connected to the grill mounting surface 130 and extending in arcuate fashion (see FIG. 4) away therefrom in the same direction At least the outermost ring element 134A is connected to outer ends 138A of the finger elements 138 for thereby supporting the interconnected central portion 132, ring elements 134 and support elements 136 in a spaced relation from the grill mounting surface 130.

Finally, the intake grill 56 includes a plurality of stiffening elements 140 disposed between adjacent ones of the support elements 136 and connected to various adjacent ring elements 134 as may be useful or necessary to ensure that the grill assembly 56 is adequately stiff to meet safety requirements. The stiffening elements 140 are effectively shortened versions of the support elements 136 that, akin to the support elements 136, are arcuately canted in the predetermined direction of rotation of the fan blade and extend along imaginary spiral lines that duplicate the spiral centerlines of the support elements 136 but are located circumferentially between adjacent support elements 136.

It may be observed that the intake grill 56 has numerous openings providing air passages between the ring elements 134 and between the finger elements 138. The precise configurations and locations of the support elements 136 may be optimized by trial and error and in general will depend on the shape of the fan blades, the distance between the fan blades and the intake grill, the speed of rotation of the fan blades, and the amount of air passing through the intake grill.

Preferably, the grill mounting surface 130, the inner central portion 132, the concentric ring elements 134, the finger elements 138, the arcuate support elements 136, and the stiffening elements 140 are a one-piece molded plastic structure. Since the grill mounting surface 130 of the particular embodiment illustrated in the drawings forms part of the venturi mounting ring assembly 46, the entire assembly 46 and the intake grill 56 are of a one-piece construction. Optionally, parts of the fan assembly 10 including the intake grill 56 could be made from metal which, if sufficiently inherently stiff, may render unnecessary the use of the stiffening elements 140.

While the intake grill 56 which is the subject of this invention is shown in conjunction with a fan assembly 10 which is convertible between window and desk or floor use, it should be understood that the intake grill 56 can be used with other types of fan assemblies.

Although the presently preferred embodiment of this invention has been disclosed, it will be understood that various changes may be made within the scope of the appended claims. For example, those familiar with the art will recognize that other embodiments are possible wherein the support elements 136 are discontinuous provided that each of the ring elements 134 is connected to and supported by at least its adjacent ring elements 134 by means of support elements 136 or stiffening elements 140.

I claim:

1. An intake grill for a fan assembly having a fan with a fan blade which rotates in a predetermined direction, said fan assembly having an intake grill mounting surface having a central opening, said intake grill comprising:

an inner central portion spaced from said grill mounting surface;

a plurality of ring elements disposed in mutually spaced, concentric relation to one another and about said central portion;

means for attaching at least an outermost one of said ring elements to said grill mounting surface; and a plurality of support elements connected to said ring elements, each of said support elements having an inner end and an outer end and extending along imaginary lines located such that said outer end of each said support element is displaced from said inner end thereof in the predetermined direction of fan blade rotation.

2. The intake grill of claim 1 wherein each said support element has a spiral configuration with its outer end radially and circumferentially displaced from its inner end in the predetermined direction of fan blade rotation.

3. The intake grill of claim 1 wherein aid attaching means comprises a plurality of mutually circumferentially-spaced finger elements having inner ends connected to said grill mounting surface and extending away therefrom in a generally common direction, said finger elements having outer ends connected to and supporting at least said outermost ring element in spaced relation from said grill mounting surface such that said interconnected ring elements, said central portion and said support elements are thereby supported in spaced relation from the grill mounting surface.

4. The intake grill of claim 1 wherein said grill mounting surface, said inner central portion, said concentric ring elements, said finger elements, and said support elements are a one-piece molded plastic structure.

5. The intake grill of claim 1 wherein said inner end of each support element extends approximately in tangential relationship to said central portion.

6. The intake grill of claim 1 wherein said outer end of each support element is displaced within the range of approximately from ninety degrees to one hundred-twenty degrees from its inner end.

7. The intake grill of claim 1 further comprising a plurality of stiffening elements disposed between adjacent ones of said support elements and connected to said ring elements.

8. The intake grill of claim 7 wherein said stiffening elements are shorter in length than said support elements.

9. The intake grill of claim 7 wherein said stiffening elements are arcuately canted in the predetermined direction of fan blade rotation.

10. The intake grill of claim 7 wherein said stiffening elements are arcuately canted in the predetermined direction of fan blade rotation and extend along imaginary spiral lines that duplicate the centerlines of the support elements but are located circumferentially between adjacent ones of said support elements.

* * * * *

UNITED STATES PATENT AND TRADEMARK OFFICE

CERTIFICATE OF CORRECTION

PATENT NO. : 5,118,252

DATED : June 2, 1992

INVENTOR(S) : David B. Chaney

It is certified that error appears in the above-indentified patent and that said Letters Patent is hereby corrected as shown below:

Column 6, line 25, Claim 3,
line 1 "aid" should read --said--.

Signed and Sealed this

Eighteenth Day of June, 1996

Bruce Lehman

*Attest:*

BRUCE LEHMAN

*Attesting Officer*

*Commissioner of Patents and Trademarks*